US010569987B2

(12) United States Patent
Conte et al.

(10) Patent No.: US 10,569,987 B2
(45) **Date of Patent: *Feb. 25, 2020**

(54) METHOD FOR IMPLEMENTING A CORRECT WINDING OF A WIRE ON A SPOOL

(71) Applicant: SAMP S.p.A CON UNICO SOCIO, Bentivoglio (IT)

(72) Inventors: Enrico Conte, Bentivoglio (IT); Roberto Conte, Bentivoglio (IT)

(73) Assignee: SAMP S.P.A. CON UNICO SOCIO, Bentivoglio (IT)

( * ) Notice: Subject to any disclaimer, the term of this patent is extended or adjusted under 35 U.S.C. 154(b) by 16 days.

This patent is subject to a terminal disclaimer.

(21) Appl. No.: 15/513,092

(22) PCT Filed: Sep. 23, 2015

(86) PCT No.: PCT/IB2015/057339

§ 371 (c)(1),
(2) Date: Mar. 21, 2017

(87) PCT Pub. No.: WO2016/046769

PCT Pub. Date: Mar. 31, 2016

(65) Prior Publication Data

US 2017/0247219 A1 Aug. 31, 2017

(30) Foreign Application Priority Data

Sep. 23, 2014 (IT) ..... BO2014A0521

(51) Int. Cl.
*B65H 54/28* (2006.01)

(52) U.S. Cl.
CPC ..... *B65H 54/2878* (2013.01); *B65H 54/28* (2013.01); *B65H 54/2848* (2013.01);
(Continued)

(58) Field of Classification Search
CPC ..... B65H 54/2878; B65H 54/2854; B65H 54/28; B65H 2515/31; B65H 2511/222;
(Continued)

(56) References Cited

U.S. PATENT DOCUMENTS 4,133,035 A * 1/1979 Grohowski ..... B65H 54/80 242/362.1
9,809,416 B1 * 11/2017 Spruell ..... B65H 63/08
(Continued)

FOREIGN PATENT DOCUMENTS

DE 19645992 A1 5/1998
DE 102011015802 10/2012
(Continued)

OTHER PUBLICATIONS

International Search Report and Written Opinion, PCT/IB2015/057339, 16 pages.
(Continued)

*Primary Examiner* — Bernard G Lindsay
*Assistant Examiner* — Saad M Kabir
(74) *Attorney, Agent, or Firm* — Matthew A. Pequignot; Pequignot + Myers

(57) ABSTRACT

A method for implementing a correct winding of a wire on a spool. The method is characterized in that it comprises a step for calculating the angular speed of a motor displacing a wire dispensing device according to the wire winding pitch and according to the pulling error, detected in relation to a given pre-set set-point and to a tolerance value, in order to determine the presence of a possible "valley error", or of a possible "peak error". Furthermore, if during the spool winding a "valley error" or a "peak error" is detected, the control device decides whether to slow down or to increase the speed of the wire dispensing device with the aim of filling the valley or of skipping the peak.

7 Claims, 2 Drawing Sheets

(52) U.S. Cl.
CPC .... *B65H 54/2854* (2013.01); *B65H 2511/222* (2013.01); *B65H 2515/31* (2013.01)

(58) Field of Classification Search
CPC ... B65H 54/2848; B65H 2557/10; B65H 1/00
See application file for complete search history.

(56) References Cited

U.S. PATENT DOCUMENTS

| | | | | |
|---|---|---|---|---|
| 2007/0284472 | A1* | 12/2007 | Lammermann ..... | B65H 54/286<br>242/397.5 |
| 2013/0284848 | A1* | 10/2013 | Hashimoto ..... | B65H 67/048<br>242/477.1 |

FOREIGN PATENT DOCUMENTS

| | | | | |
|---|---|---|---|---|
| DE | 102011015802 | A1 * | 10/2012 | ..... B65H 54/2818 |
| DE | 102011015802 | A1 | 10/2012 | |
| JP | 1990-2215658 | | 8/1990 | |
| JP | 2003341934 | A * | 12/2003 | |
| JP | 2003341934 | A | 12/2003 | |
| JP | 2006008310 | A | 1/2006 | |
| JP | 2007-290870 | | 11/2007 | |
| WO | 0039013 | A1 | 7/2000 | |
| WO | 2004024606 | A2 | 3/2004 | |

OTHER PUBLICATIONS

Office Action, dated Jul. 2, 2019, in Japan Application No. 2017-515964 by Examiner Hiroto OOYAMA (enclosed herewith).

* cited by examiner

METHOD FOR IMPLEMENTING A CORRECT WINDING OF A WIRE ON A SPOOL

TECHNICAL FIELD

The present invention relates to a method for implementing a correct winding of a wire on a spool.

Incidentally, it should be pointed out that what is referred to as "wire" in this context could be an insulated or non-insulated metallic wire, an insulated or non-insulated strand, a rope, filaments, glass fibres and the like.

BACKGROUND ART

As is known, peaks and valleys in a winding are caused by irregularities in the surface of the spool core, the progressive overlapping of the wire layers, the loosening of winding tension due to problems with the path of the wire, etc.

The formation of peaks and valleys is also possible at a spool flange owing to the incorrect position of the flange; this is the case when, for example, the "effective winding width" of a spool is different from the pre-set one, taking into account the kind of spool.

The formation of peaks and valleys is also promoted by possible irregularities in the flange geometry (for example, the presence of deformed flanges); or fittings between the core, spool and flanges that are large in relation to the wire diameter or the size of the surrounding circle. Moreover, flanges can also be deformed during the progressive filling of the spool due to the pulling of the skein of wire.

Other causes of peak and valley formation can be, for example, loosening and/or delayed movement of the wire due to the reversal of the direction of movement of the wire dispensing device, or irregularities in the wire distribution due to size; for example, a wire with a large diameter tends to have an inertia that is difficult to control.

It is known, moreover, that in the winding operation there is a constant datum, regardless of the section, namely, the wire always tends to lag behind with respect to the movement of the wire dispensing device that distributes it. This phenomenon becomes more pronounced the further the wire dispensing device moves away from the spool and the more the cross-section of the wire increases.

In standard applications, both when the wire dispensing device is connected mechanically to the spool rotation and when the wire dispensing device is controlled separately, the linear translational speed of the wire dispensing device is kept constant throughout a single layer of deposited wire. This means that in the end there are no changes to the winding pitch in the various layers. In addition, during the gradual filling of the spool, the linear speed of the wire dispensing device decreases in such a way as to have a constant winding pitch as the diameter of the skein of wire wound on the spool increases.

For instance, in U.S. Pat. No. 7,370,823 B2 (NIEHOFF) a system is described that takes into account:

- the wire speed;
- the value of the winding diameter, calculated or detected by one or more sensors mounted on the wire dispensing device; and
- the spool position and angular speed (through a speed or position detector), which are correlated in order to avoid the formation of peaks and valleys.

At the flanges, the use of one or more sensors enables their position to be detected and, again taking the wire speed, the winding diameter and the spool angular position into account, these are correlated to define the presence of peaks and/or valleys and take immediate action to reverse the direction of the wire dispensing device in order to fill a valley (delaying the moment in which the direction is reversed or stopping the movement of the device) or not lay wire (by reversing the movement in advance).

Although the system described in U.S. Pat. No. 7,370,823 B2 (NIEHOFF) allows a fairly precise control of the wire winding on the spool, it is expensive and sometimes unreliable due to the fact that controls are performed by means of speed sensors.

DISCLOSURE OF INVENTION

Therefore, the main aim of the present invention is to provide a method for implementing a correct winding of a wire on a spool, which overcomes the problems described above and, at the same time, is both easy and cost-effective to implement.

The present method was designed to obtain better quality wire laying, particularly with "non-coil-coil" wire laying, in the presence of peaks or valleys on the winding surface, and the correction of winding defects at the spool flanges.

As is known, the "coil-coil" type process is when the wire is laid in such a way that the sides of the wire touch one another. In this case, the winding pitch is equal to the wire diameter. Normally, to obtain a better unwinding, the winding pitch tends to increase (approximately 1.3-1.6 times the diameter) so as to create a crossing pattern between one layer and another.

The method according to the present invention is based on a different system, which makes use, preferably, but not necessarily, of synchronous electric motors (particularly brushless motors with integrated drive, or decentralized in relation to size and control in space), at least one device designed to measure the wire pulling action and appropriate sensors. According to a particular embodiment, the device suited to measure the wire pulling action comprises a load cell.

According to a further embodiment (not shown) the device suitable to measure the wire pulling action comprises a take up roll.

Thus, the system uses the combination of effects due to the type of motors used, the installation of one or more control sensors to check the presence of the spool, and the correlation between the linear speed of the incoming wire (determined by a capstan), the "calculated winding diameter" (also called "servodiameter") and the wire pulling measurement detected by means of an appropriate sensor. In particular, this sensor is a load cell.

As is known, the servodiameter is the diameter of a skein calculated during the process of winding the wire on a spool.

During the step of loading the spool in the machine, the operator places it on a loading device and controls its loading on the machine (the spool is brought to a suitable height in order to be closed between two ends (manually or automatically)). At the end of this operation, before allowing the loading system to be lowered, the machine, through a "spool presence detector" checks—for safety reasons—that the ends of the spool have been properly gripped by detecting the position of the flanges. The data collected are then compared with the data set in the machine, and the conformity of the loaded spool with the type pre-set in the "production formula" is verified.

When this operation is complete, if the tests are positive, the load device can be lowered.

An operator can now bind the wire on the spool and the winding machine is ready to begin the winding operation.

The winding operation begins with the gradual acceleration of the machine from a speed of zero to a given pre-set production speed.

During the winding operation, in a generic layer, the winding speed is calculated by correlating the linear speed of the wire with the servodiameter ("calculated winding diameter") in order to maintain the set winding tension (defined by the wire type). The set winding tension is controlled by comparing the wire pulling measurement, performed by a device designed to measure such pulling action, with the pre-set value.

Several methods can be used to calculate the winding linear speed:

- measuring the linear speed of the wound wire and the angular speed of the winding spool; this measurement must be properly filtered to avoid miscalculations owing to disturbance of measurements; or
- using the coil diameter at the beginning of the winding and subsequently correcting the outside diameter of the skein by measuring the wire pulling action.

The datum set on the wire type is expressed in $N/mm^2$. The comparison is carried out by a software which transforms the reading of the wire pulling action performed by the load cell, a reading that is corrected in relation to the section of the wire.

While winding, the translation speed of the wire dispensing device is defined by correlating the wire linear speed, the servodiameter and the winding pitch defined by the kind of production.

In the presence of a valley or of a peak, and thus of an instant change in the winding diameter in relation to the servodiameter, the wire pulling action changes, generating a signal variation that is construed as the presence of a peak or a valley, thus giving rise to a change in the speed of travel of the wire dispensing device.

During the gradual filling of a layer, the transversely mobile wire dispensing device approaches the spool flange, and a position corresponding to the position stored during the test to check the correct insertion of the spool is taken as the theoretical reverse point.

When the wire dispensing device approaches this theoretical position, if a peak or a valley is detected (and therefore an instant change in the diameter of the winding in relation to the servodiameter) the change in the wire pulling action is construed as the presence of a peak or of a valley, thus resulting in the reverse command being sent in advance, or delayed, in relation to the theoretical instant. The area in which this correction is performed is defined in the machine technical parameters, and it is related to the spool type.

Appropriate control strategies have been developed to interpret the change in the wire pulling action correctly in order to ensure the correct elimination of both peaks and valleys.

Moreover, the mobile wire dispensing device may accidentally be blocked during the winding step.

In such a case, the wire is laid on the same point, piling up (creating the so-called "rough") and the wire pulling action therefore changes. The instant value of the wire pulling action is correlated with the translation speed value of the wire dispensing device making it possible to stop the machine in order to avoid the production of waste material, and to protect the machine from accidental damage when the wire breaks after piling up.

In accordance with the present invention, a method as defined in independent claim 1, and preferably in any of the claims directly or indirectly depending on the independent claim, is provided.

In addition, a further purpose of the present invention is to provide a machine for winding a wire on a spool; the machine being suitable to implement a method for obtaining a correct winding of a wire on a spool.

BRIEF DESCRIPTION OF THE DRAWINGS

The present invention will now be described with reference to the accompanying drawings, which illustrate a non-limiting example of an embodiment of a machine for winding a wire on a spool, in which.

BEST MODE FOR CARRYING OUT THE INVENTION

Figure 1:
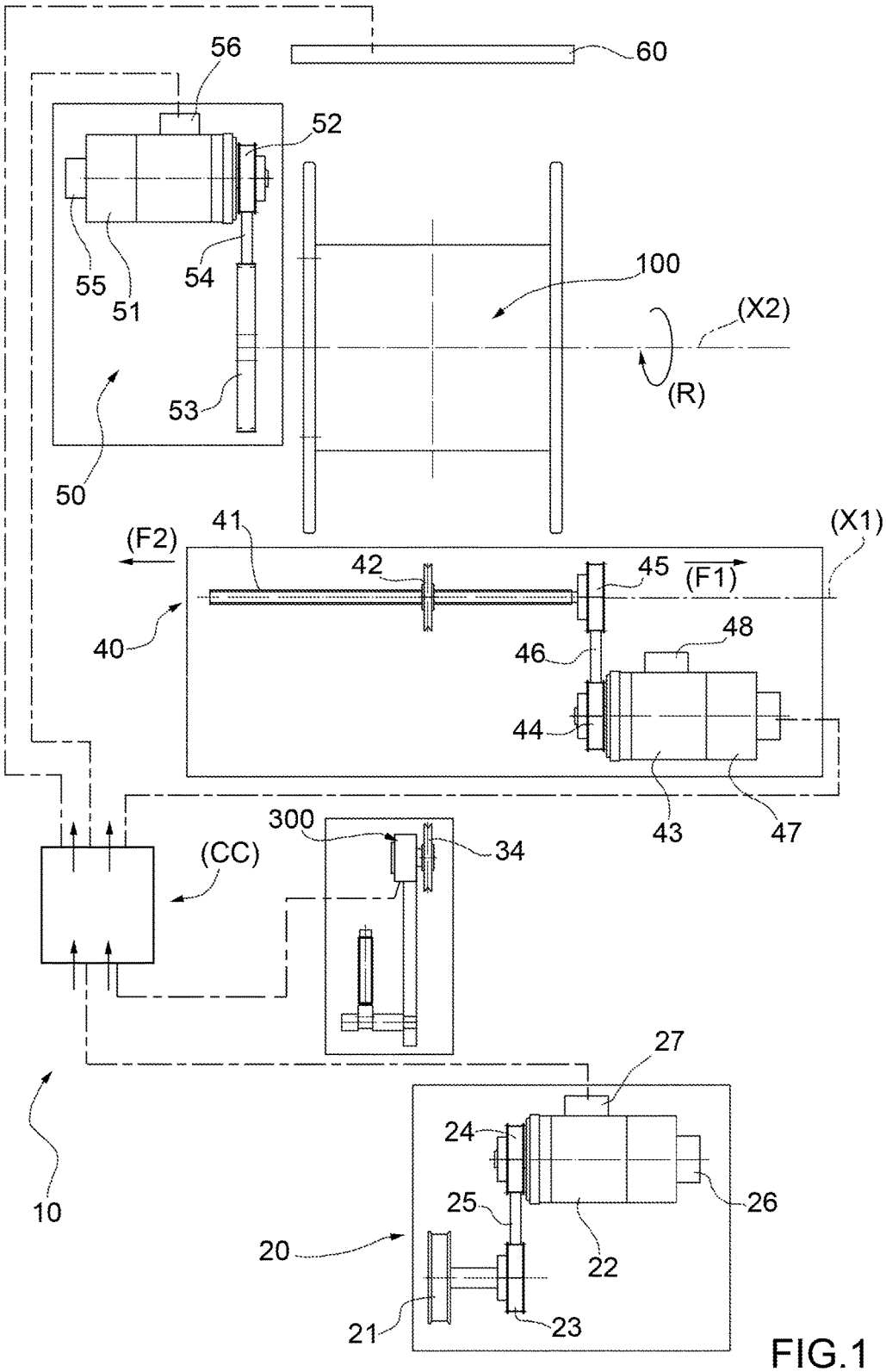
FIG. 1 schematically illustrates a machine for correctly rewinding a wire on a spool; said machine being suitable to implement the method which is the main object of the present invention.

In FIG. 1, number 10 denotes, as a whole, a machine for winding a wire on a spool 100, on which the method according to the invention can be implemented.

Figure 2:
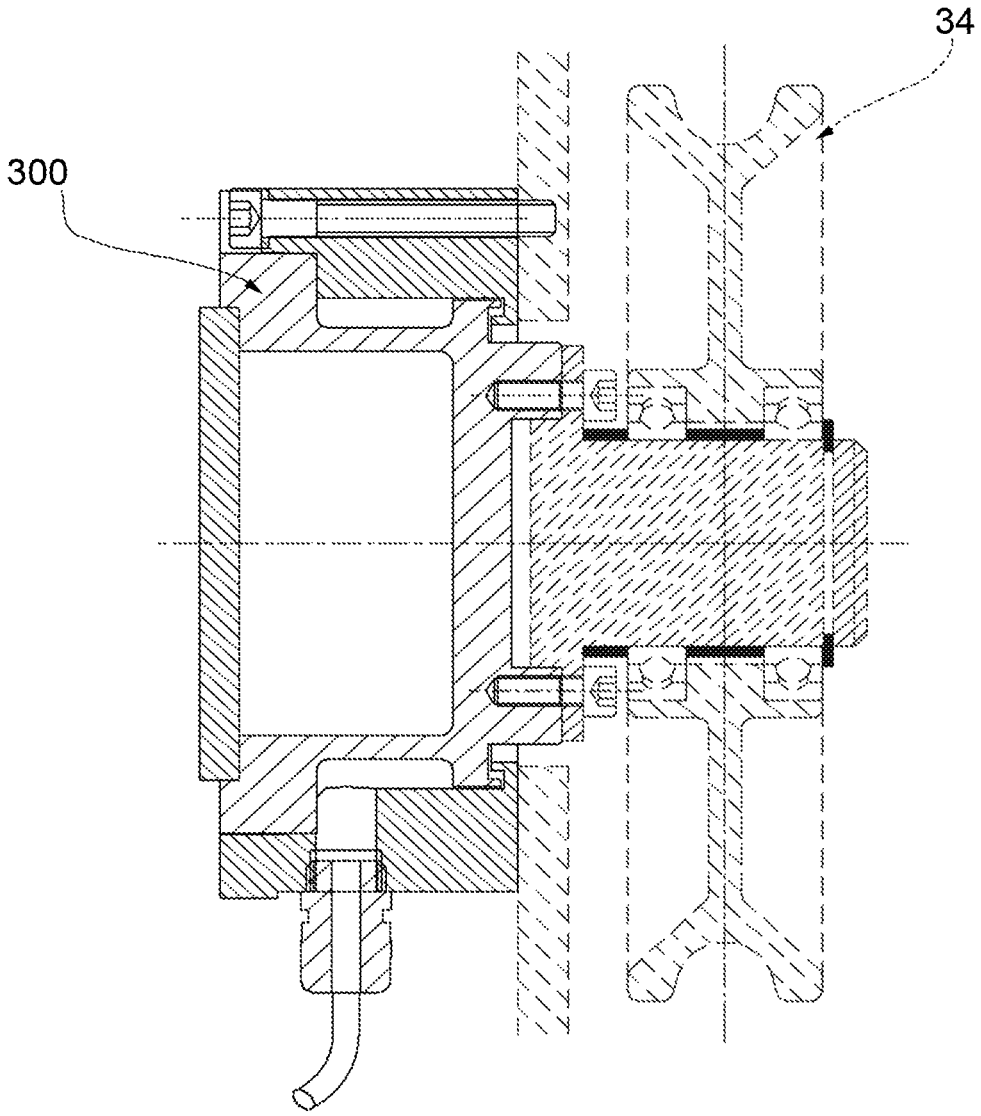
FIG. 2 illustrates some details of the machine in FIG. 1 on an enlarged scale.

The machine 10 comprises the following devices, placed in-line:

(a) a feeding device 20 of a wire (not shown) to be wound around the spool 100; said feeding device 20 comprises, in a known manner, a pulling ring 21 made to rotate by a synchronous electric motor 22 (for example, a brushless motor) by means of a pair of pulleys 23, 24, linked together by a belt 25; the synchronous electric motor 22 is connected to a relative encoder 26, and it is controlled by an electronic board 27;

(b) an assembly comprising a load cell 300 (FIG. 2), to which a spindle is attached, on which a wire transmission pulley 34 is rotatably mounted;

(c) a wire dispensing device 40 comprising a worm screw 41 to control the translation of a pulley 42 of the wire dispensing device along an axis (X1) and following one of the two directions defined by the arrows (F1), (F2); the worm screw 41 is made to rotate by a synchronous electric motor 43 (for example, a brushless motor) by means of a pair of pulleys 44, 45 linked together by a belt 46; the synchronous electric motor 43 is connected to a relative encoder 47, and it is controlled by an electronic board 48;

(d) a spool assembly 50, comprising said spool 100, on which the wire (not shown) is wound so as to form a skein of wire (not shown); the spool assembly 50 also includes a respective synchronous electric motor 51, which makes the spool 100 rotate (around an axis (X2)—arrow (R)) by means of a pair of pulleys 52, 53 linked by a belt 54; the synchronous electric motor 51 is connected to a corresponding encoder 55 and is controlled by an electronic board 56; and (e) a sensor 60 suitable to read the position of the spool 100 and the configuration of its skein containment flanges; in particular, preferably, but not necessarily, the sensor 60 is not mounted on the wire dispensing device 40.

Incidentally, it should be said that each electronic board 27, 48, 56, coupled with the respective encoder 26, 47, 55, performs both power control functions (used in the conversion from direct current into alternating current), and functions of mere software control of the data received/sent from/to the respective encoder 26, 47, 55.

According to a preferred embodiment of the invention, a DC bus architecture is used.

However, using a more complex construction, the same operation could be obtained with DC motors and AC/DC converters and with AC motors and AC/AC converters.

The electronic boards, 27 48, 56, a load cell 300 and the sensor 60 controlling the spool are connected electronically to an electronic control unit (CC), which may or may not be built into the machine 10, that manages all functions for controlling and operating the components of the machine 10.

The method according to the present invention comprises the following steps:

(f1) setting the main geometrical data of the spool on an operator panel of the electronic control unit (by means of dedicated formulas or by means of manually entered data);

(f2) loading a spool on the machine;

(f3) acquiring the position of the spool flanges by means of said sensor;

(f4) calculating the actual spool position and comparing it with the "spool data" set in advance in the electronic control unit in order to check whether the spool loading was successful and whether the spool is consistent with that expected;

(f5) continuing with the process if the check is positive; or stopping the process and reporting the problem by means of an alarm signal;

(f6) manually binding the wire to the spool; an operator starts production by activating a specific command;

(f7) reading the starting measure of the wire pulling action according to the construction and geometrical shape of the support/load cell assembly;

(f8) calculating the servodiameter according to the spool data, the production data and the reading of the pulling measure; and (f9) calculating the speed of the spool motor according to the servodiameter, with the aim of maintaining a constant winding pulling action.

The present method is characterized in that it comprises a further step for calculating the angular speed of a motor displacing the wire dispensing device according to the wire winding pitch and according to the pulling error, detected in relation to a given pre-set set-point and to a tolerance value, in order to determine the presence of a possible "valley error", or of a possible "peak error". The method is also characterized in that, if a "valley error" or a "peak error" is detected during the spool winding, the control device decides whether to slow down or to increase the speed of the wire dispensing device with the aim of filling the valley or of skipping the peak.

The main advantage of the method according to the present invention lies in its reliability. Moreover, to implement the present method, all that is required is a winding machine that envisages the use of a small number of sensors. Furthermore, with the present solution the winding machine operator does not have to continuously/frequently correct the reverse position of the wire dispenser device, thereby reducing the amount of time the operator has to spend on a single machine. In this way, each individual operator can manage a larger number of winding machines.

The invention claimed is:

1. A method for implementing a correct winding of a wire on a spool of a wire winding machine, the method comprising the following steps:

(f1) setting main geometrical data of the spool on an operation panel of an electronic control unit;

(f2) loading a spool on said wire winding machine;

(f3) acquiring positions of the spool flanges by means of at least one sensor;

(f4) calculating the actual spool position and comparing it with spool data stored in advance in the electronic control unit in order to check whether the spool loading was successful and whether the spool is consistent with expected parameters;

(f5) continuing with the process if the check indicates successful spool loading; or stopping the process and reporting the problem by means of an alarm signal, if the check indicates unsuccessful spool loading;

(f6) binding the wire to the spool; an operator starts the production by activating a specific command;

(f7) reading a starting measure of the wire pulling action according to shape and construction geometry of a support/load cell assembly;

(f8) calculating a servodiameter of the spool according to said spool data, production data, and the reading of said starting measure; and (f9) calculating the speed of a spool motor according to said servodiameter with the aim of maintaining a constant winding pulling action; and said method characterized in that it includes a further step for calculating the angular speed of a motor displacing a wire dispensing device according to a wire winding pitch and according to a pulling error, which is detected in relation to a given pre-set set-point and to a tolerance value, in order to determine the presence of a possible valley error, or of a possible peak error; and in that if during the spool winding a valley error or a peak error is detected, the control device decides whether to slow down or to increase the speed of the wire dispensing device with the aim of filling the valley or skipping the peak.

2. The method, according to claim 1, characterized in that it comprises a further step wherein a reversal position of said wire dispensing device is calculated according to the spool flange position detected by said sensor during the spool loading, and according to an error of a device able to measure the wire pulling action; said error being used to determine the presence of a valley or of a peak, and therefore to increase or to reduce the reversal position.

3. The method, according to claim 2, characterized in that said device able to measure the wire pulling action comprises at least one load cell.

4. The method, according to claim 1, characterized in that it comprises a further step for calculating the length of the wire wound as a skein on said spool.

5. A machine for winding a wire on spool, characterized in that it is configured to implement a method for a correct winding of a wire on a spool according to claim 1.

6. A machine, according to claim 5, characterized in that it comprises at least one device able to measure the wire pulling action, so as to use measured values for carrying out the correct winding of the wire on the spool.

7. A machine, according to claim 6, characterized in that said device able to measure the wire pulling action comprises at least one load cell.

* * * * *